US011510544B2

(12) United States Patent
Khubani

(10) Patent No.: US 11,510,544 B2
(45) Date of Patent: Nov. 29, 2022

(54) SURFACE CLEANING DEVICE WITH SWEEPER

(71) Applicant: Ontel Products Corporation, Fairfield, NJ (US)

(72) Inventor: Ashok Khubani, Palm Beach Gardens, FL (US)

(73) Assignee: ONTEL PRODUCTS CORPORATION, Fairfield, NJ (US)

( * ) Notice: Subject to any disclaimer, the term of this patent is extended or adjusted under 35 U.S.C. 154(b) by 420 days.

(21) Appl. No.: 16/905,098

(22) Filed: Jun. 18, 2020

(65) Prior Publication Data

US 2020/0405114 A1 Dec. 31, 2020

Related U.S. Application Data

(60) Provisional application No. 62/866,306, filed on Jun. 25, 2019.

(51) Int. Cl.

| | |
|---|---|
| ***A47L 11/22*** | (2006.01) |
| ***A47L 9/14*** | (2006.01) |
| ***A47L 9/04*** | (2006.01) |
| ***A46B 9/06*** | (2006.01) |
| ***A47L 9/28*** | (2006.01) |
| ***A47L 11/33*** | (2006.01) |
| ***A46B 13/00*** | (2006.01) |

(Continued)

(52) U.S. Cl.

CPC ..... *A47L 11/22* (2013.01); *A46B 9/06* (2013.01); *A46B 13/001* (2013.01); *A46B 13/02* (2013.01); *A47L 9/0411* (2013.01); *A47L 9/0477* (2013.01); *A47L 9/1409* (2013.01); *A47L 9/149* (2013.01); *A47L 9/2884* (2013.01); *A47L 11/33* (2013.01); *A46B 2200/30* (2013.01); *A47L 9/12* (2013.01)

(58) Field of Classification Search

CPC ..... A47L 11/22; A46B 9/06; A46B 13/001; A46B 13/02

See application file for complete search history.

(56) References Cited

U.S. PATENT DOCUMENTS

| | | | |
|---|---|---|---|
| 5,165,134 | A | 11/1992 | Moore |
| 5,735,959 | A | 4/1998 | Kubo et al. |

(Continued)

FOREIGN PATENT DOCUMENTS

| | | |
|---|---|---|
| GB | 1208062 | 10/1970 |
| WO | 2010087970 A1 | 8/2010 |

OTHER PUBLICATIONS

30 Minute Lithium Powered Floor Sweeper; Black & Decker; 7 pages; Date accessed: Jan. 3, 2019.

(Continued)

*Primary Examiner* — Andrew A Horton

(74) *Attorney, Agent, or Firm* — Dickinson Wright PLLC

(57) ABSTRACT

A surface cleaning device for removing debris from a surface is described. The surface cleaning device comprises a cleaning head comprising a housing, wherein the housing defines an inlet and comprises brush chambers; at least one vent coupled to a top portion of the housing; and a sweeper assembly coupled to the housing and comprising brushes having bristles, wherein the cleaning head is configured create a suction with a surface by directing air flow into the housing through the inlet and out of the housing through the at least one vent.

20 Claims, 7 Drawing Sheets

(51) Int. Cl.
*A46B 13/02* (2006.01)
*A47L 9/12* (2006.01)

(56) References Cited

U.S. PATENT DOCUMENTS

| | | | | |
|---|---|---|---|---|
| 6,584,990 | B2 | 7/2003 | Shaw | |
| 7,013,528 | B2 | 3/2006 | Parker et al. | |
| 7,048,804 | B2 | 5/2006 | Kisela et al. | |
| 7,137,169 | B2 | 11/2006 | Murphy et al. | |
| 7,152,267 | B2 | 12/2006 | Kaleta | |
| 7,340,795 | B2 | 3/2008 | Kaleta | |
| 7,591,039 | B2 | 9/2009 | Kaleta et al. | |
| 8,230,540 | B1 * | 7/2012 | Nelson | A47L 11/33 15/83 |
| D693,079 | S | 11/2013 | Nordvik | |
| 9,655,486 | B2 | 5/2017 | Xu et al. | |
| 9,974,423 | B2 | 5/2018 | Policicchio et al. | |
| 2005/0011536 | A1 | 1/2005 | Hofte et al. | |
| 2005/0268410 | A1 | 12/2005 | Kaleta | |

OTHER PUBLICATIONS

30 Minute Lithium Powered Floor Sweeper; Black & Decker; 4 pages; Date accessed: Jan. 3, 2019.

* cited by examiner

SURFACE CLEANING DEVICE WITH SWEEPER

CROSS-REFERENCE TO RELATED APPLICATIONS

This application claims priority to U.S. Provisional Patent Application Ser. No. 62/866,306, filed on Jun. 25, 2019, the entire disclosure of which is incorporated herein by reference.

TECHNICAL FIELD

This disclosure relates generally to a surface cleaning sweeper device for cleaning a surface.

BACKGROUND

A surface cleaning device, such as a broom, a sweeper, or a vacuum cleaner, can be used to clean a variety of surfaces, such as wood, tile, and carpeted floors. Surface cleaning devices can collect small debris (e.g., sand, dust-sized particles), large debris (e.g., crumbs, clumps of dirt, and pebbles), and table debris (e.g., hair, floss, animal fur, and string) from floors and other surfaces using suction and rotatable roller brushes. Surface cleaning devices may have too much or too little suction for a specific type of surface, resulting in inadequate cleaning. Debris, such as long animal fur, floss, string, and hair may become tangled in the roller brushes, which can prevent the roller brushes from rotating properly thereby decreasing the effectiveness of the surface cleaning device. It can be difficult to remove all debris from the roller brushes and such removal may not be possible or may result in damage to the surface cleaning device. Surface cleaning devices may have wheels to allow for movement over a surface. Wheels may restrict movement of the surface cleaning device, requiring more force to move the surface cleaning device thereby preventing full rotation of the surface cleaning device. This makes it particularly hard to clean in hard-to-reach surface areas.

SUMMARY

This section provides a general summary of the present disclosure and is not a comprehensive disclosure of its full scope or all of its features, aspects, and objectives.

Disclosed herein are exemplary implementations of a surface cleaning device. In some aspects, a surface cleaning device comprises a cleaning head comprising a housing, wherein the housing defines an inlet and comprises brush chambers; at least one vent coupled to a top portion of the housing; and a sweeper assembly coupled to the housing and comprising brushes having bristles, wherein the cleaning head is configured create a suction with a surface by directing air flow into the housing through the inlet and out of the housing through the at least one vent.

In other aspects, a surface cleaning device comprises a cleaning head comprising a housing, wherein the housing defines an inlet and comprises brush chambers adjacent to a perimeter of the housing; at least one vent coupled to a top portion of the cleaning head; and a sweeper assembly coupled to the housing and comprising brushes having bristles, wherein the sweeper assembly defines a gap between the bristles and the brush chambers; and wherein the cleaning head is configured create a suction with a surface by directing air flow into the housing through the inlet and out of the housing through the at least one vent.

In yet other aspects, a surface cleaning device comprises a handle assembly having a tubular shape and extending between a first end and an opposing second end; a cleaning head coupled to the second end of the handle assembly and comprising a housing, wherein the housing defines an inlet and comprises brush chambers; a sweeper assembly coupled to the housing, wherein the sweeper assembly comprises brush chambers configured to receive brushes, wherein the brushes comprise a plurality of soft and hard bristles; at least one vent coupled to a top portion of the housing, wherein the cleaning head is configured create a suction with a surface by directing air flow into the housing through the inlet and out of the housing through the at least one vent; a rim coupled to a bottom edge of the housing, wherein the rim is configured to reduce an amount of tangle debris contacting the brushes and break the tangle debris in contact with the plurality of soft and hard bristles; and a debris container coupled to the housing, the debris container comprising an angled flap configured to move at least one of the debris and the tangle debris into the debris container.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The terminology used herein is for the purpose of describing particular example embodiments only, and is not intended to be limiting. As used herein, the singular forms "a," "an," and "the" may be intended to include the plural forms as well, unless the context clearly indicates otherwise.

The terms first, second, third, etc. may be used herein to describe various elements, components, regions, layers and/or sections; however, these elements, components, regions, layers and/or sections should not be limited by these terms. These terms may be only used to distinguish one element, component, region, layer, or section from another region, layer, or section. Terms such as "first," "second," and other numerical terms, when used herein, do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," "top," "bottom," "right," "left," and the like, may be used herein. These spatially relative terms can be used for ease of description to describe one element's or feature's relationship to another element(s) or feature(s) as illustrated in the figures. The spatially relative terms may also be intended to encompass different orientations of the device in use, or operation, in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptions used herein interpreted accordingly.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
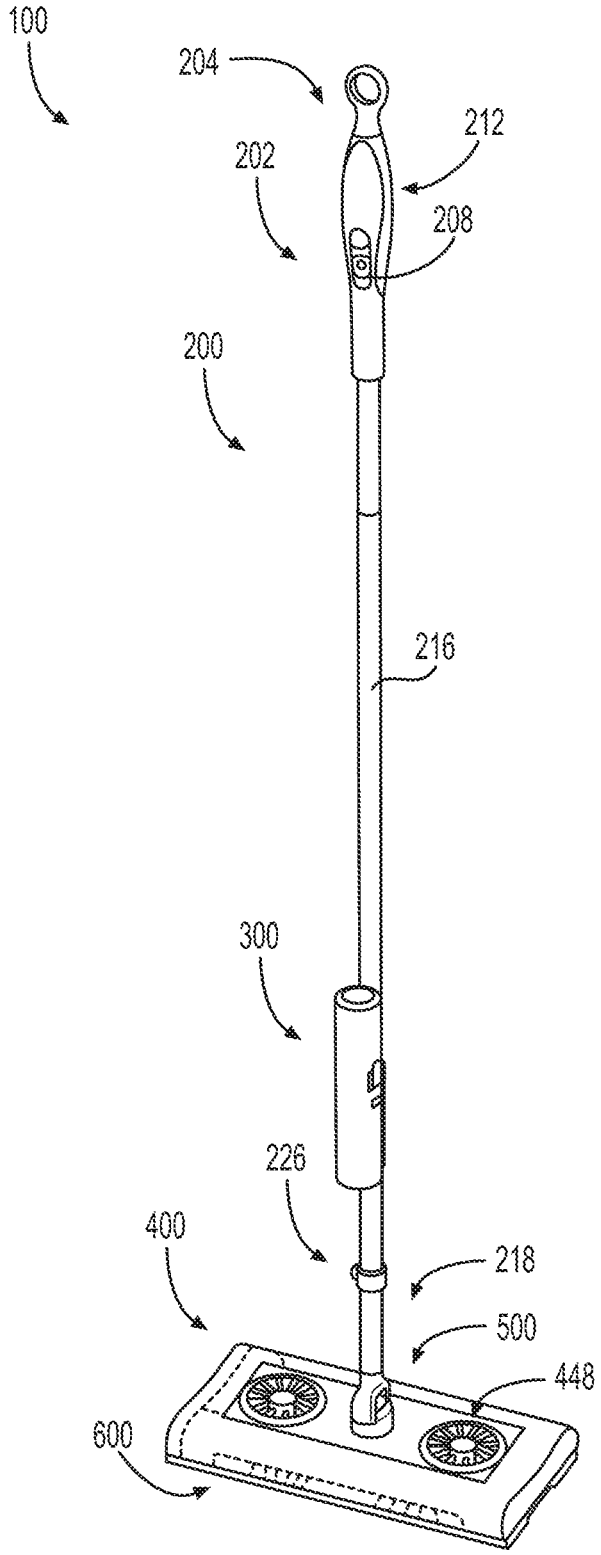
FIG. 1 is a perspective view of a surface cleaning device in accordance with aspects of the present disclosure.
Figure 2:
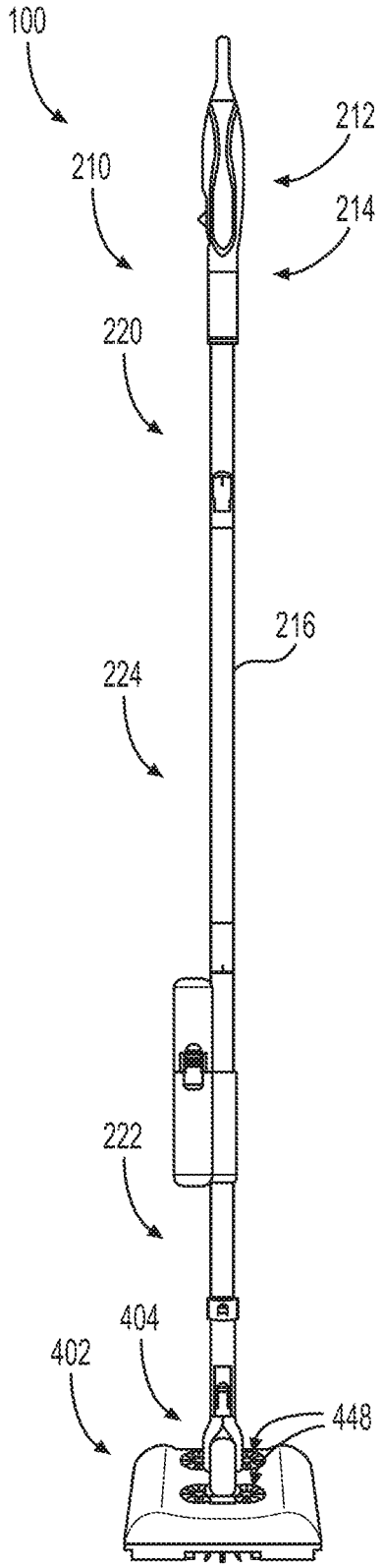
FIG. 2 is a side view of the surface cleaning device in accordance with aspects of the present disclosure.
Figure 3:
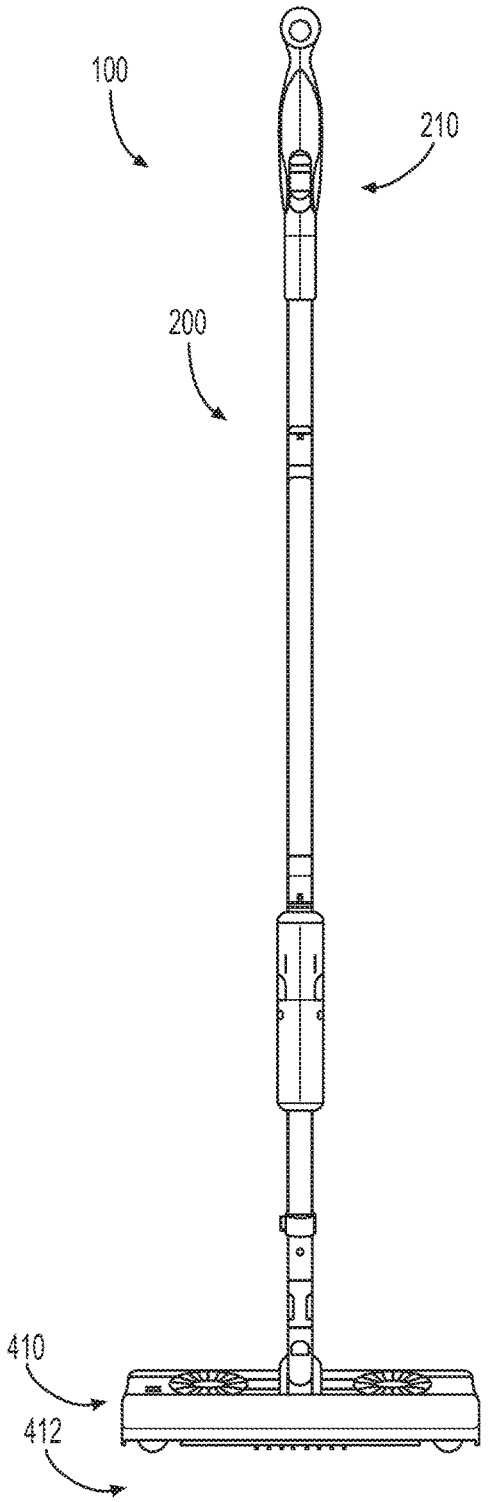
FIG. 3 is a front view of the surface cleaning device in accordance with aspects of the present disclosure.
Figure 4:
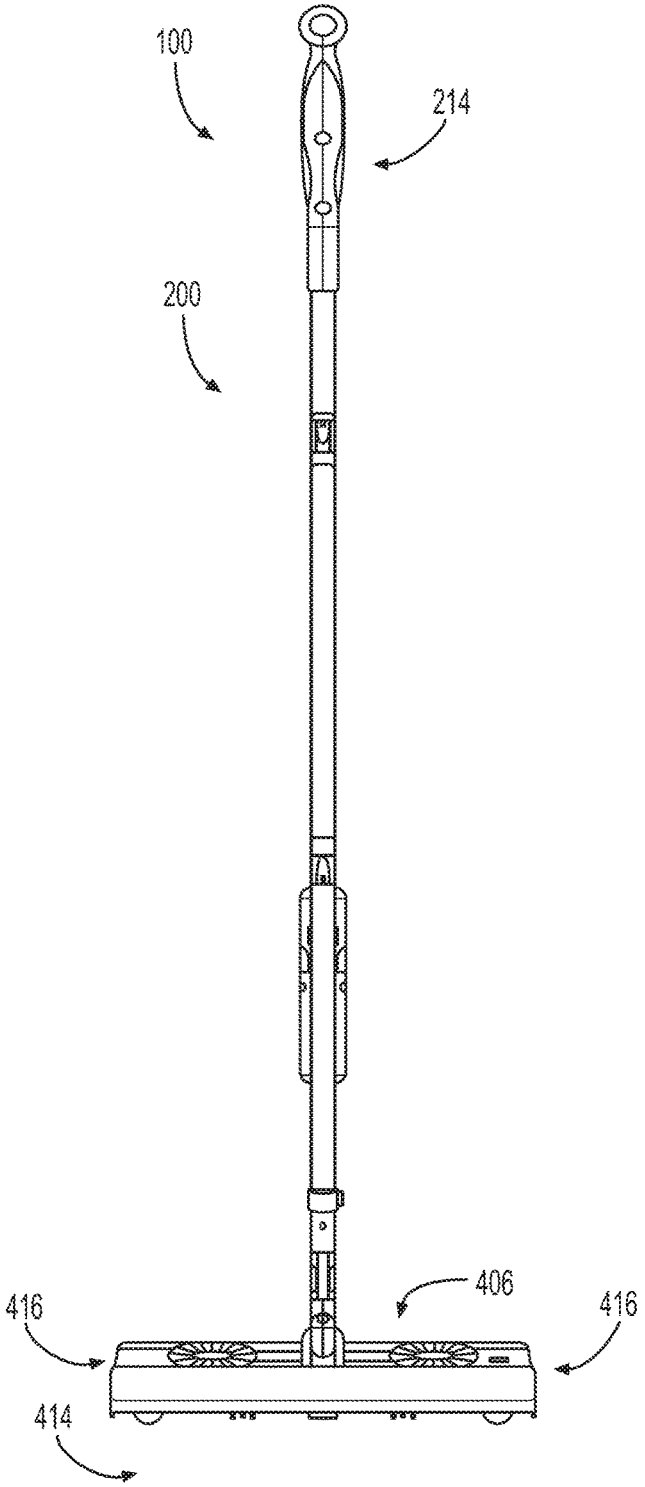
FIG. 4 is a rear view of the surface cleaning device in accordance with aspects of the present disclosure.

The following description is merely exemplary in nature and is not intended to limit the disclosure in its application or uses. For purposes of clarity, the same reference numbers are used in the description and drawings to identify similar elements.

FIGS. 1-4 illustrate an exemplary surface cleaning device 100 in accordance with aspects of the present disclosure. The surface cleaning device 100 can include a handle assembly 200, a battery assembly 300, a cleaning head assembly 400, a motor assembly 500, and a sweeper assembly 600.

Figure 5:
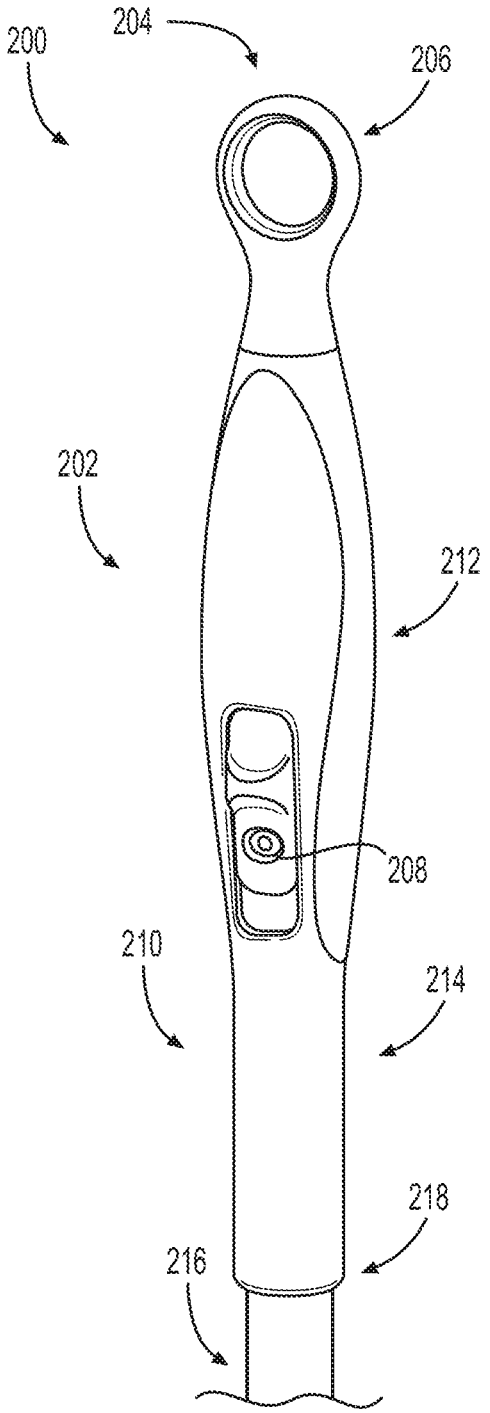
FIG. 5 is a perspective view of a handle of the surface cleaning device in accordance with aspects of the present disclosure.

The handle assembly 200 can include a handle 202. FIG. 5 illustrates an exemplary handle 202 of the surface cleaning device 100. The handle 202 can be formed at a top end, such as a first end 204 of the handle assembly 200. The handle 202 can be formed of plastic, rubber, or any other desired material. The handle 202 can be oblong in shape or any other desired shape. The handle 202 can have ergonomic features for the comfort of a user.

The handle 202 can include a hanger 206. The hanger 206 can be positioned at the first end 204. The hanger 206 can be a ring or any other desired shape. The hanger 206 can rotate. For example, the hanger 206 can rotate 360 degrees or any other desired degrees about the handle 202. The hanger 206 can be used to hang the surface cleaning device 100, for example, on a hook, for storage or any other desired purpose. The hanger 206 can rotate to provide more convenient and efficient storage of the surface cleaning device 100.

The handle assembly 200 can include a switch, such as a motor switch 208. The motor switch 208 can be a power button, switch, or any other desired device positioned on the handle assembly 200. For example, the motor switch 208 can be coupled to the handle 202. The motor switch 208 can be coupled to a front portion 210 of the handle assembly 200. The motor switch 208 can be coupled to the handle 202 proximal to the first end 204, or any other desired location. The motor switch 208 can be in communication with the battery assembly 300. The motor switch 208 can be in communication with the motor assembly 500. The motor switch 208 can be coupled to a motor, wherein the motor switch 208 can be configured to control a speed of the motor 502. For example, the speed of the motor 502 can include at least one of a first speed and a second speed. The first speed can be a slow speed and the second speed can be a speed faster than the first speed. The first speed can be a fast speed and the second speed can be a speed slower than the first speed. The motor switch 208 can be configured activate or deactivate the motor 502 (i.e., turn the motor 502 ON or OFF). The handle 202 can be configured for a user to view the position of the motor switch 208.

The handle assembly 200 can have a grip 212. The grip 212 can be coupled to the handle 202. The grip 212 can be located on a rear portion 214 of the handle assembly 200 or any other desired location. The grip 212 can be formed from the handle 202. The grip 212 can be formed of plastic, rubber, or any other desired material. The grip 212 can be smooth, have groves, or any other desired surface.

The handle assembly 200 can include a pole 216. The pole 216 can be coupled to a handle 202. The handle 202 can be connected to the first end 204 of the pole 216. The pole 216 can be telescopingly received by the handle 202, or any other desired attachment. The pole 216 can be formed as an elongated arm having a tubular shape and extending between a first end 204 and a second end 218. The pole 216 can include one or more segments. For example, the pole 216 can include a first segment 220 proximal to the first end 204 of the surface cleaning device 100 and a second segment 222 proximal to the second end 218 of the surface cleaning device 100. The first segment 220 can be telescopingly received by the second segment 222. The pole 216 can include additional segments 224 positioned between the first and second segments 220, 222, or any other desired position. The additional segments 224 can be telescopingly received by the first segment 220, the second segment 222, other additional segments 224, or any other desired device.

Figure 6:
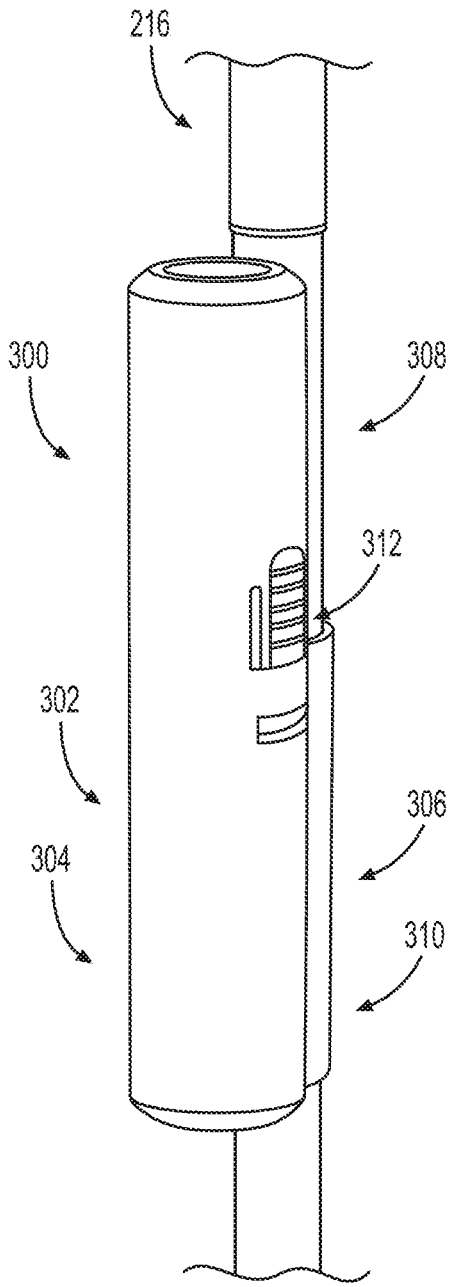
FIG. 6 is a perspective view of a battery assembly of the surface cleaning device in accordance with aspects of the present disclosure.

FIG. 6 illustrates an exemplary battery assembly 300 of the surface cleaning device 100. The battery assembly 300 can be coupled to the handle assembly 200, the pole 216, or any other desired location. The battery assembly 300 can be coupled to the pole 216 using a sleeve 306, a clip, clamp, magnet, screw, or any other desired attachment means. The battery assembly 300 can include a battery housing 314. The battery housing 314 can be formed of plastic, metal, or any other desired material. The battery housing 314 can include two sections 308, 310 or any other desired configuration. The battery housing 314 can include a slide 312, button, switch, lever, clip or any other device to separate two sections of the battery housing 314. The battery housing 314 can be opened to access at least one battery 304. The at least one battery 304 can be positioned in the battery housing 314. The at least one battery 304 can be electrically connected to the motor 502 for providing power to the motor 502. The battery 304 can be electrically connected to the motor 502 and to the motor switch 208 to allow a user to turn the motor 502 ON and OFF. The battery 304 can also be configured to change the speed of the motor 502. The battery housing 314 can be configured for wires to travel though for connection with the battery 304. The battery 304 can be any desired energy source, such as a re-chargeable lithium ion battery or nickel metal hydride (NiMH) battery.

The handle assembly 200 can include a first magnet 226. The first magnet 226 can be coupled to the handle assembly 200, including the pole 216, or any other desired location. The first magnet 226 can be coupled to the handle assembly 200 using a clamp, a clip, a screw, or any other desired attachment means.

The cleaning head assembly 400 can include a cleaning head 402. A mounting mechanism 404, such as a joint, universal joint, or any other desired mounting mechanism can be used to couple the cleaning head assembly 400 to the handle assembly 200. The mounting mechanism 404 can be used to couple the cleaning head assembly 400 to the second end 218 of the handle assembly 200, such as coupling to pole 216. The mounting mechanism 404, such as universal joint, can be configured to allow the pole 216 to pivot 360 degrees about the universal joint.

The cleaning head assembly 400 can include a top portion 406, a bottom portion 408, and sides 410. The sides 410 may include a front side 412, a rear side 414, and lateral sides 416 extending between the front and rear sides 412, 414, or any other desired side. The cleaning head assembly 400 can be formed as a rectangle, oval, circle, square, or any other desired shape or configuration. The cleaning head 402 can include a base being planar and having a top surface 420 and a bottom surface 422, and a front edge 424, a rear edge 426, and a pair of lateral side edges 428 extending between the front and rear edges 424, 426.

The cleaning head assembly 400 can include a housing 440. The housing 440 can be coupled to the cleaning head 402. The housing 440 can be located over the top portion 406 of the cleaning head 402. The housing 440 can be located about the sides 410 of the cleaning head 402. The housing 440 can be a larger shape or configuration than the cleaning head 402 and cover portions of the cleaning head 402. The housing 440 can have a front portion 442, a rear portion 444, lateral side portions 446 expending between the front and rear portions 442, 444. The housing 440 can have a bottom portion 408. The bottom portion 408 of the housing 440 can include edges. For example, the bottom portion 408 of the front portion 442 of the housing 440 can include a front edge 424. The bottom portion 408 of the rear portion 444 of the housing 440 can include a rear edge 426. The bottom portion 408 of the lateral side portions 446 of the housing 440 can include a pair of lateral side edges 428 extending between the front and rear edges 424, 426. The bottom portion 408 of the housing 440 can be formed from the front, rear, and side edges 424, 426, 428.

The housing 440 can define at least one inlet 432. The at least one inlet 432 can include a front inlet 434, a rear inlet 436, side inlet 438, any other desired opening, or combination thereof. The front inlet 434 can be defined by the housing 440 adjacent to the front edge 424 of the bottom portion 408 of the cleaning head 402. The rear inlet 436 can be defined by the housing 440 adjacent to the rear edge 426 of the bottom portion 408 of the cleaning head 402. The side inlets 438 can be defined by the housing 440 adjacent to the pair of lateral side edges 428 of the bottom portion 408 of the cleaning head 402. The at least one inlet 432 can be configured to allow air and debris to enter under the housing 440 and into the cleaning head 402.

The housing 440 can include a rim 430. The rim 430 can be coupled to or formed from the bottom edge of the housing 440. The rim 430 can be teeth, rows of teeth, a sharp edge, or any other desired configuration. The rim 430 can prevent tangle debris, such as hair, floss, animal fur, and string, from contacting a brush 604 located within the housing 440. The rim 430 can break tangle debris in contact with the brush 604 or a plurality of soft and hard bristles 638. For example, the rim 430 can be configured as a comb to clean off or remove tangle debris from the bristles.

Figure 7:
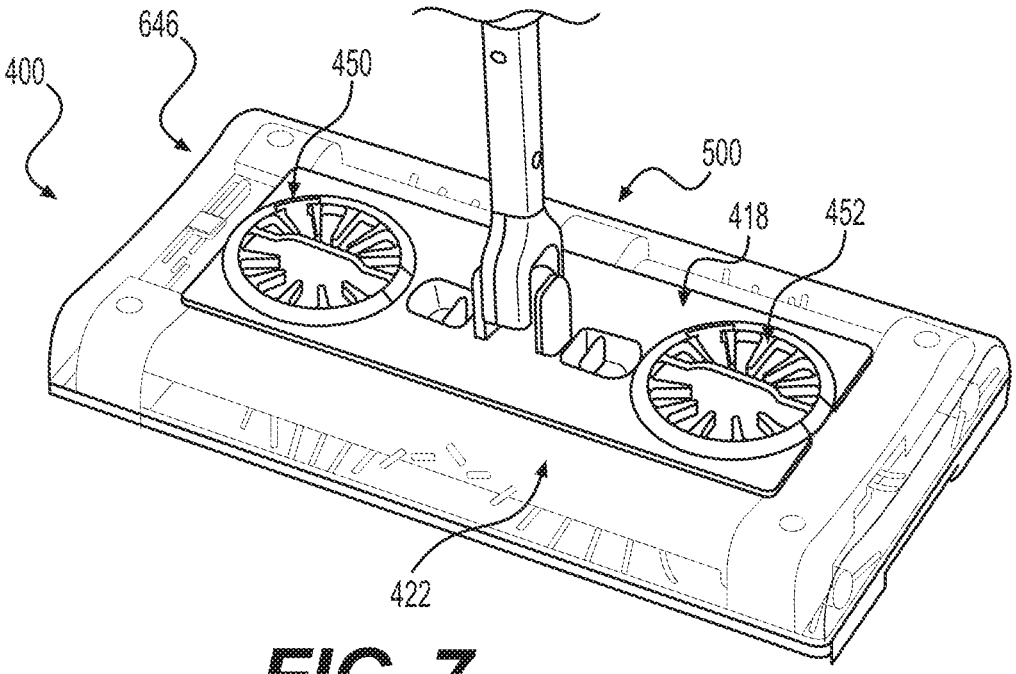
FIG. 7 is a top perspective view of a cleaning head assembly of the surface cleaning device in accordance with aspects of the present disclosure.
Figure 8:
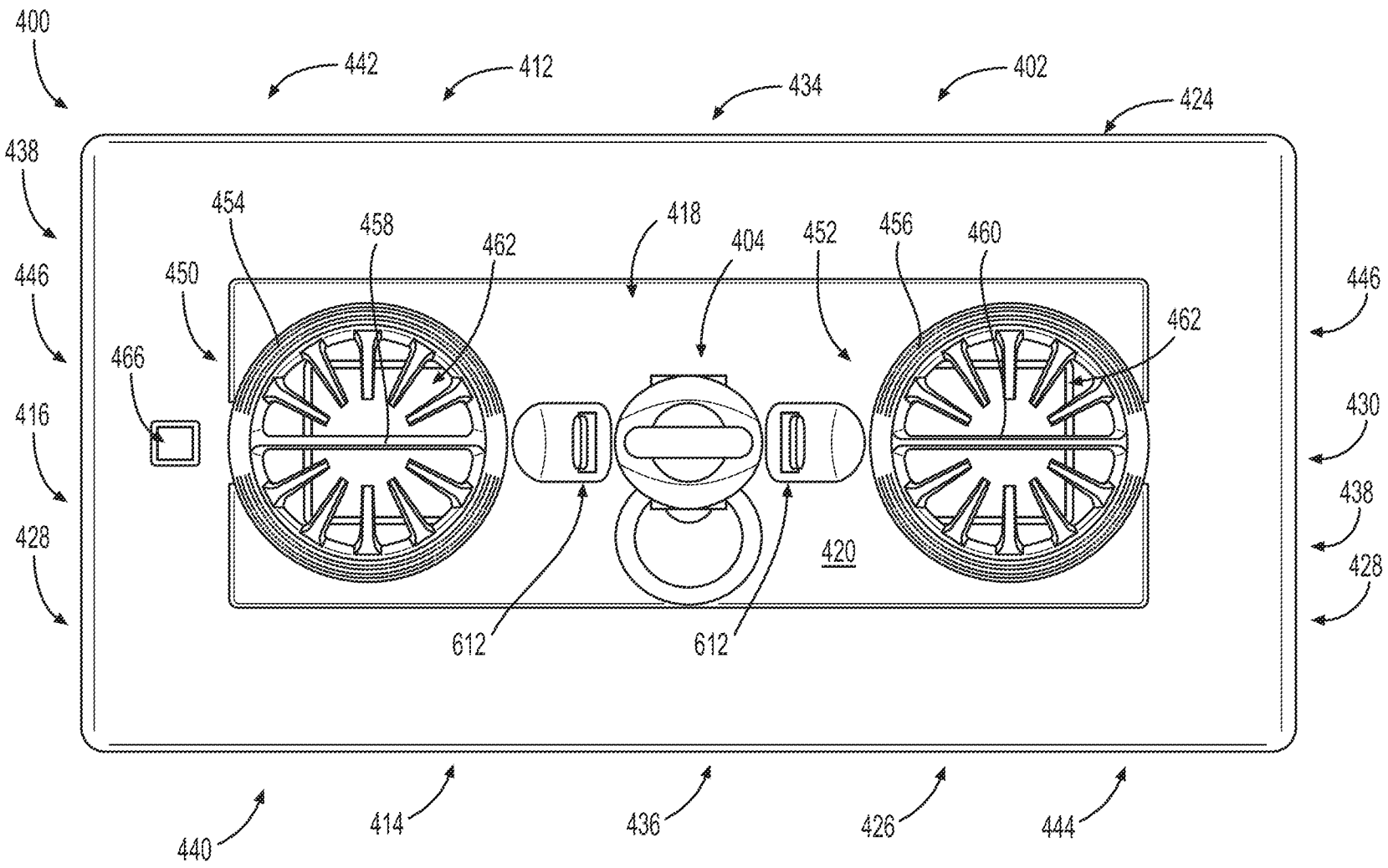
FIG. 8 is a top view of the cleaning head assembly of the surface cleaning device in accordance with aspects of the present disclosure.

FIGS. 7-8 illustrate an exemplary top portion 406 of the cleaning head assembly 400. The cleaning head 402 can comprise one or more vents 448. The vents 448 can be circular or any other desired shape. The vents 448 can be coupled to the cleaning head 402. The vents 448 can be disposed through the top portion 406 of the cleaning head 402. The vents 448 can be positioned with a portion of the vent 448 above the top portion 406 and a portion below the top portion 406 of the cleaning head 402. The vents 448 can be located on opposing sides 410 of the cleaning head 402. For example, a first vent 450 can be positioned adjacent one side of the pole 216 and a second vent 452 can be positioned adjacent an opposing side of the pole 216.

In one embodiment, two vents 448, such as the first vent 450 and the second vent 452, can be coupled to the top portion 406 of the cleaning head 402, or any other desired number or configuration of vents 448. The first vent 450 can be coupled to a first portion of the cleaning head 402. The first vent 450 can be coupled to a first vent cover 454. A first vent tab 458 can be coupled to the first vent cover 454. The first vent tab 458 can be moved to lock or unlock the first vent cover 454 from the first vent 450.

The second vent 452 can be coupled to a second portion of the cleaning head 402. The second vent 452 can be coupled to a second vent cover 456. A second vent tab 460 can be coupled to the second vent cover 456. The second vent tab 460 can be moved to lock or unlock the second vent cover 456 from the second vent 452.

The vents 448 can have a filter 462, such as a mesh filter or any other desired filter 462. The filter 462 can prevent debris from entering into the vents 448 from outside of the cleaning head 402. The vent cover 454 can be removed for cleaning or replacing. The filter 462 can be removed for cleaning or replacing. For example, the first vent tab 458 can be moved to unlock the first vent cover 454 from the first vent 450. The first vent cover 454 can be removed from the first vent 450. The filter 462 can be accessed. For example, a user can twist the vent tab 458 a quarter turn in a first direction to unlock the vent cover 454 and pull up the vent cover 454 out of the vent 450. The user can insert the vent cover 454 into the vent 450 and twist the vent tab 458 in a second opposing direction to lock the vent cover 454 into the vent 450.

The two vents 448 coupled to a top portion 406 of the cleaning head 402 can be in fluid communication with a brush chamber 602 and the brush 604. The air can flow through the vents 448, such as first and second vents 450, 452, and the brush chamber 602 to create a suction with a surface, such as a floor, wall, carpet, or any other desired surface. The vents 448 can be configured to create a vacuum airflow that creates suction. The vents 448, in combination with the brush 604, a brush chamber 602, and internal components 464 of the cleaning head 402 positioned within the housing 440, can be configured to create airflow to vacuum debris into the cleaning head 402.

The cleaning head assembly 400 can include a second magnet 466. The second magnet 466 can be coupled to the cleaning head 402. The second magnet 466 can be coupled to a top portion 406 of the cleaning head 402 on the same side of the surface cleaning device 100 as the first magnet 226. The cleaning head 402 can rotate toward the pole 216 of the handle assembly 200 until the second magnet 466 contacts or engages with the first magnet 226. The magnets can hold the cleaning head 402 in a position substantially parallel to the pole 216 to reduce the profile of the surface cleaning device 100, such as for storage purposes. The user can rotate the cleaning head 402 to disengage the magnets 226, 466.

Figure 9:
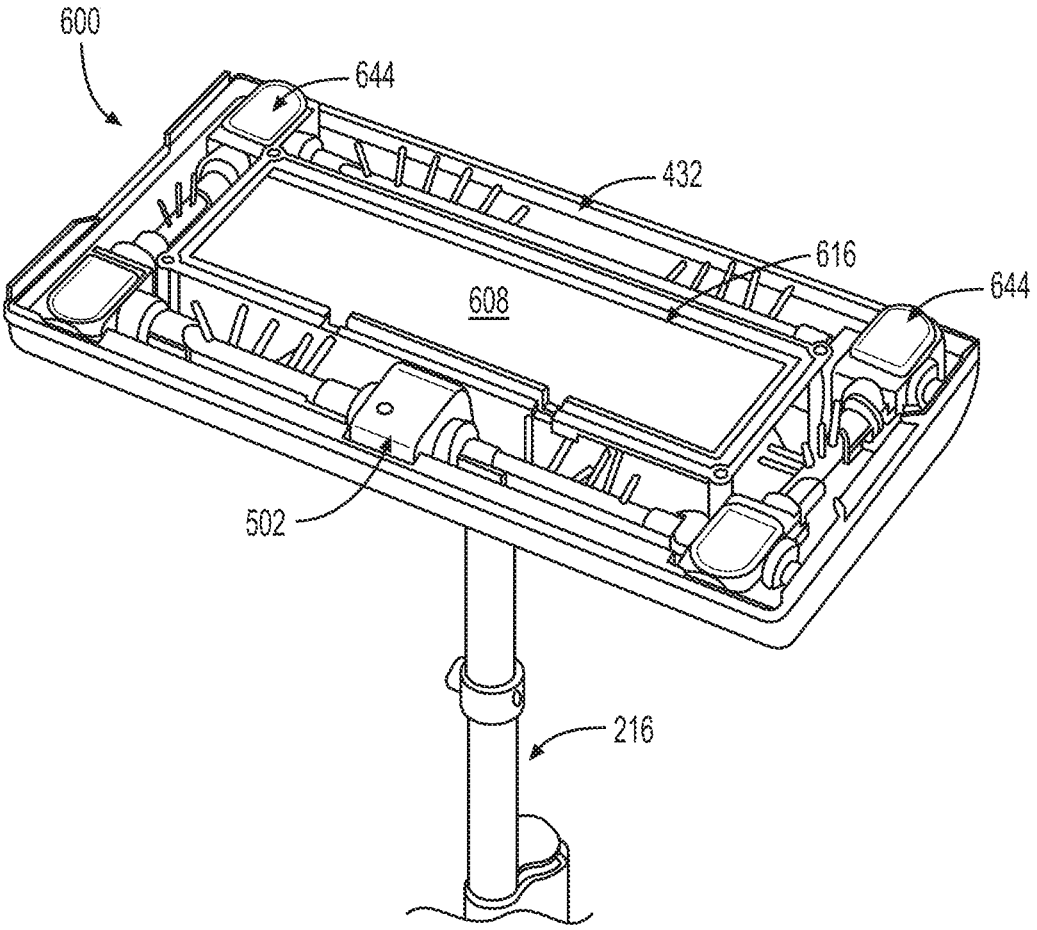
FIG. 9 is a bottom perspective view of a cleaning head assembly of the surface cleaning device in accordance with aspects of the present disclosure.
Figure 10:
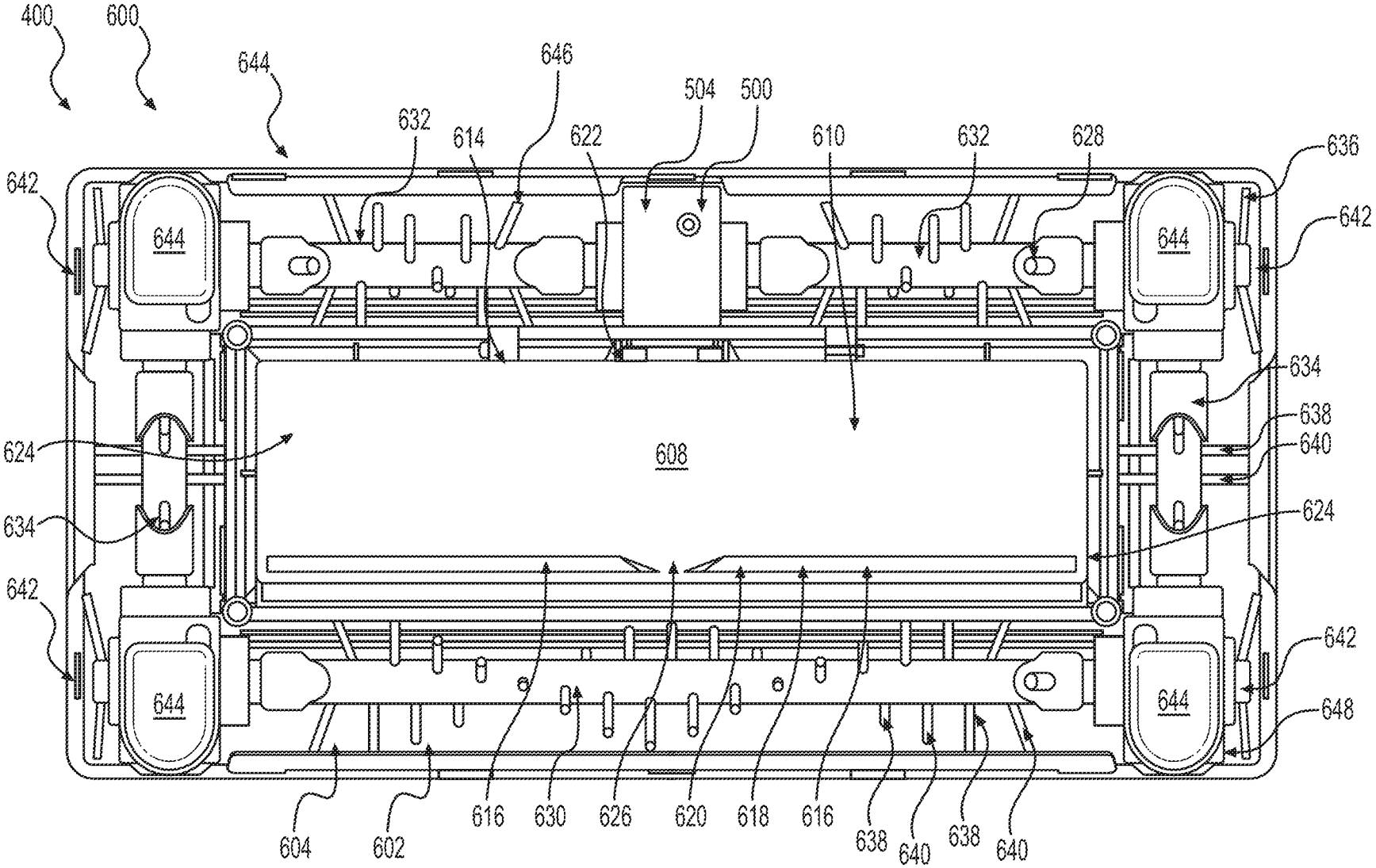
FIG. 10 is a bottom view of the cleaning head assembly of the surface cleaning device in accordance with aspects of the present disclosure.

FIGS. 9-10 illustrate an exemplary bottom portion 408 of the cleaning head assembly 400 of the surface cleaning device 100. The sweeper assembly 600 can be coupled to the cleaning head 402. The sweeper assembly 600 can include a debris container 606. The debris container 606 can be coupled to the cleaning head 402, including to the top surface 420 of the cleaning head 402, or any other desired location. The debris container 606 can be disposed within the housing 440. The debris container 606 can include a housing 440 having a front side 620, a rear side 622, a pair of lateral sides 624, and a lid 608 and defining a compartment 610. The debris container 606 can be rectangular or any other desired shape. The lid 608 can be pivotably connected to a portion of the housing 440, such as the front side 620 of the housing 440, the debris container 606, any other desired side, portion, or combination thereof. The debris container 606 can define an inlet (e.g., debris inlet 626) configured to collect debris. The debris collected may be stored in the debris container 606, for example, until a user empties that debris from the debris container 606. The lid 608 can be angled to coordinate with movement of the bristles. The debris can shoot up the lid 608 and into the debris container 606.

A debris release trigger 612 can be disposed on the top portion 406 of the cleaning head 402. The debris release trigger 612 can include one or more tabs 644, button, or any other desirable mechanism, that when pressed together or activated in any suitable way, can uncouple a portion of the lid 608 from the cleaning debris container 606. When the lid 608 is in an open position (i.e., partially uncoupled from the debris container 606), debris can be removed from the debris container 606. The lid 608 can be pivoted to allow the debris container 606 to open and remove any collected and stored debris. For example, a hinge 614, or any other desired pivotable device, can be coupled to the lid 608 and a side of the debris container 606. When the debris release trigger 612 is activated, the debris container 606 can open while the side remains attached to the bottom portion 408 of the cleaning head 402 via the hinge 614. When a user is finished emptying the debris container 606, the user can close the lid 608, such as by snapping the lid 608 into the debris container 606, or using any other desirable closing mechanism.

The debris container 606 can have one or more angled flaps 616 configured to move debris into the debris container 606. As shown in FIG. 10, two angled flaps 616 are coupled to a front portion 618 of the debris container 606. The angled flaps 616 can taper toward one another and toward the debris inlet 626. The angled flaps 616 can be configured to guide debris into the debris container 606. The angled flaps 616 can be formed of plastic, rubber, or any other desired material.

The sweeper assembly 600 can include a one or more brush chambers 602 disposed within the housing 440. The suction can pull debris, including smaller debris particles, into the surface cleaning device 100. The brush chambers 602 can be located around an inner periphery of the housing 440. The brush chambers 602 can be defined between the housing 440 and the debris container 606. The housing 440 is configured to allow air to flow through the two vents 448 and the brush chamber 602 to create suction with the surface.

The sweeper assembly 600 can include one or more brushes, such as a plurality of brushes 604. The brush 604 can be disposed within the brush chamber 602. The brush 604 can include a roller 628 and bristles 636. The bristles 636 can be coupled to, such as being embedded into, the roller 628. The roller 628 can be a front roller 630, a rear roller 632, one or more side rollers 634, or any other desired roller. The front roller 630 can be positioned in the brush chamber 602 of the housing 440 and extending between the pair of lateral sides 416 along an axis in alignment with the inlet 432. The front roller 630 can rotate about the axis. The rear roller 632 can be positioned in the brush chamber 602 parallel to and along the opposing side of the housing 440 as the front roller 630. The one or more side rollers 634 can be positioned in opposing brush chambers 602 of the housing 440 and extending between the front and rear sides 412, 414 along a perpendicular axis to the axis. One or more rollers 628 can be positioned along any side of the housing 440. The roller 628 can be formed as a bar or rod of plastic, metal, wood, or any other desired material or shape.

In one exemplary embodiment, the sweeper assembly 600 can include a plurality of brushes 604 including a plurality of bristles 636 extending radially outwardly from the roller 628 for sweeping debris into the debris container 606 in response to rotation of the roller 628. The plurality of brushes 604 can be coupled to the sweeper assembly 600 about a perimeter, such as an inner perimeter, of the cleaning head 402. The sweeper assembly 600 can be configured to define a gap 646 between the bristles 636 and the brush chambers 602. The gap 646 provides an area between the housing 440 and the bristles 636. When the brushes 604 rotate, the bristles 636 can rotate without touching the housing 440. The sweeper assembly 600 can be configured to define one or more gaps 646 in one or more brush chambers 602.

The brush 604 can include hard bristles 638 and soft bristles 640. The hard bristles 638 can be formed from a rough material, such as Palmyra; plastic, such as polypropylene and nylon; stiff fibers; any other desirable material; or combination thereof. The soft bristles 640 can be formed from fibers, natural plant-based material, soft plastic, any other desirable material; or combination thereof. The hard bristles 638 and/or the soft bristles 640 may be cut flat, shaped at an angle, coiled, flagged, unflagged, any other desired shape, or combination thereof. The hard bristles 638 and/or the soft bristles 640 may be configured to sweep debris from a flat surface, such as tile and wood flooring; a carpet, including a plush carpet; a rough surface, such as concrete floors, asphalt, and walkways, any other desired surface, or combination thereof. The brush 604 can include a first row or set of soft bristles 640 and a first row or set of hard bristles 638. The brush 604 can include the hard bristles 638 and soft bristles 640 spaced out and alternating in position along the brush 604, alternating in a two to one ratio of hard to soft bristles 638, 640, or in any other desired pattern or ratio. For example, the first set of soft bristles 640 can be adjacent the first and second sets of hard bristles 638. The second set of hard bristles 638 can be adjacent the first and second sets of soft bristles 640. Furthermore, one of the brushes 604 can include a first configuration of the hard and soft bristles 638, 640 and another of the brushes 604 can include a second configuration of the hard and soft bristles 638, 640. Each of the brushes 604 may have a plurality of soft and hard bristles 638, 640 and the combinations and positions of the plurality of hard and soft bristles 638, 640 on any of the brushes 604 are not limited by the examples illustrated in this disclosure.

The plurality of soft and hard bristles 638, 640 may extend radially outwardly from the brush 604, such as in a spiral formation, or any other desired formation. The hard bristles 638 can be stiff. The hard bristles 638 can be formed from hard density material, such as nylon. The soft bristles 640 can be more flexible than the hard bristles 638. The soft bristles 640 can be formed from material having less density than the hard bristles 638.

The sweeper assembly 600 can include a corner brush 642. The corner brush 642 can be disposed in a corner portion of the housing 440. The corner brush 642 can be configured to rotate or spin. The corner brush 642 can have bristles 636 extending radially outwardly of the corner brush 642. In one embodiment, the corner brush 642 includes a spiral of hard bristles 638. The sweeper assembly 600 can include a plurality of corner brushes 624. Each of the plurality of corner brushes 624 can be coupled to a corner of the sweeper assembly 600.

The sweeper assembly 600 can include at least two tabs 644 coupled to the bottom portion 408 of the cleaning head 402 and configured for sliding across the surface. The at least two tabs 644 can be coupled to a bottom portion 408 of the sweeper assembly 600. The sweeper assembly 600 can comprise the brushes 604 rotatably coupled to corners 468. The corners 468 can be configured to couple to tabs 644. The sweeper assembly 600 can be removably attached to the housing 220. The tabs 644 can be configured to not damage the surface. The tabs 644 can be formed of plastic or any other desired material. The at least two tabs 644 can be configured to create an inlet opening, such as inlet 432, between the bottom portion 408 of the cleaning head 402 and the surface for air to flow through the first vent 450, the second vent 452, and the inlet 432 to create suction.

In one exemplary embodiment, the sweeper assembly 600 can include four tabs 644. Each of the four tabs 644 can be positioned in a corner portion of the housing 440 or any other desired location. The four tabs 644 can create airflow as the bristles rotate to create a channel through which air can flow.

The motor assembly 500 can include a motor housing 504. The motor housing 504 can be positioned under the top surface 420 of the base 418 adjacent to the rear edge 426 and one of the lateral side edges 428 of the base 418, or any other desired location. A motor 502 can be positioned in the motor housing 504. The motor 502 can include an output shaft. The motor 502 can include a first pulley secured to the output shaft of the motor 502. The motor 502 can include a second pulley secured to the roller 628 in alignment with the first pulley. The motor 502 can include a belt. The belt can be disposed about the first and second pulleys for providing rotational movement of the roller 628 in response to rotation of the motor 502. The motor 502 can be coupled to the cleaning head 402 and configured to rotate the brush 604. The motor 502 can be configured to rotate a plurality of brushes 604. The motor 502 can rotate the brushes 604 such that the bristles 636 move in an outward to inward direction toward the debris container 606. The brush 604 or plurality of brushes 604 can move debris toward and into the debris container 606.

Wiring can be disposed within the surface cleaning device 100 to electrically couple at least the motor switch 208, the battery 304, and the motor 502. The wiring can be disposed through the handle assembly 200. The wiring can be disposed through the pole 216. The wiring can be disposed in the mounting mechanism 404, such as a universal joint, coupling the second end 218 of the handle assembly 200 to the cleaning head 402. The wiring can be disposed in the cleaning head 402 and the motor assembly 500. The wiring disposed within the handle 202 and the joint can couple the battery assembly 300, including the battery 304, to the motor 502 and the motor switch 208.

In one exemplary embodiment, the surface cleaning device 100 can include a cleaning head 402 having a housing 440 and at least one vent, such as vents 450, 452, coupled to a top portion 406 of the cleaning head 402. The surface cleaning device 100 can also include a brush chamber 602 disposed within the housing 440 and a brush 604 disposed within the brush chamber 602. The housing 440 can be configured for air to flow through the vents 450, 452 and the brush chamber 602 to create a suction with the surface.

In another exemplary embodiment, the surface cleaning device 100 can include a cleaning head 402 having a housing 440 and a rim 430 coupled to a bottom portion 408 of the housing 440. The surface cleaning device 100 can include a brush chamber 602 disposed within the housing 440 and a brush 604 disposed within the brush chamber 602. The brush 604 can include a first set of soft bristles 640 and a first set of hard bristles 638.

In another exemplary embodiment, the surface cleaning device 100 can include a handle 202 having a tubular shape and extending between a first end 204 (e.g., a top end) and a second end 218 (e.g., a bottom end) and a cleaning head 402 having a housing 440 and coupled to the second end 218 of the handle 202. The surface cleaning device 100 can include a brush chamber 602 disposed within the housing 440 and a brush 604 disposed within the brush chamber 602. The brush 604 can include a plurality of soft and hard bristles 638, 640. The surface cleaning device 100 can include a debris container 606 having an angled flap 616 configured to move debris into the debris container 606. The surface cleaning device 100 can include at least one vent, such vents 450, 452, coupled to a top portion 406 of the cleaning head 402 and in fluid communication with the brush chamber 602 and the brush 604. The air can flow through the vents 450, 452 and the brush chamber 602 to create a suction with the surface. The surface cleaning device 100 can also include a rim 430 coupled to a bottom portion 408 of the housing 440. The rim 430 can be configured to reduce tangle debris from contacting the brush 604 and break the tangle debris in contact with the plurality of soft and hard bristles 638, 640.

The surface cleaning device can include additional and/or fewer components and is not limited to those illustrated in FIGS. 1-10.

Consistent with the above disclosure, the examples of systems and methods enumerated in the following clauses are specifically contemplated and are intended as a non-limiting set of examples.

Clause 1. A surface cleaning device, comprising:

a cleaning head comprising a housing, wherein the housing defines an inlet and comprises brush chambers;

at least one vent coupled to a top portion of the housing; and a sweeper assembly coupled to the housing and comprising brushes having bristles, wherein the cleaning head is configured create a suction with a surface by directing air flow into the housing through the inlet and out of the housing through the at least one vent.

Clause 2. The surface cleaning device of any preceding clause, further comprising:

at least two tabs coupled to a bottom portion of the cleaning head and configured for sliding across the surface.

Clause 3. The surface cleaning device of any preceding clause, wherein the at least one vent further comprises:

a first vent coupled to a first portion of the cleaning head; and a second vent coupled to a second portion of the cleaning head, wherein the suction is created by air flowing into the housing through the inlet and out of the housing through the first vent and the second vent.

Clause 4. The surface cleaning device of any preceding clause, further comprising:

a vent cover removably coupled to one of the at least one vent; and a vent tab coupled to the vent cover, wherein the vent tab is configured to lock and unlock the vent cover from the at least one vent.

Clause 5. The surface cleaning device of any preceding clause, further comprising:

a debris container disposed within the housing, the debris container defining a debris inlet configured to store debris; and a debris release trigger disposed on the top portion of the cleaning head, wherein the debris release trigger is configured to release a lid pivotably coupled to the debris container to open the debris container for removal of the debris from the debris container.

Clause 6. The surface cleaning device of any preceding clause, further comprising:

a rim coupled to a bottom edge of the housing, wherein the rim is configured to at least one of preventing tangle debris from contacting the brushes and breaking the tangle debris in contact with the brushes.

Clause 7. The surface cleaning device of any preceding clause, wherein the rim comprises teeth.

Clause 8. The surface cleaning device of any preceding clause, wherein each of the brushes further comprise a roller;

wherein the bristles further comprise one or more sets of soft and hard bristles coupled to the roller; and wherein each of the one or more sets of soft and hard bristles alternate in position along the roller.

Clause 9. The surface cleaning device of any preceding clause, further comprising:

a corner brush coupled to a corner of the sweeper assembly, wherein the corner brush is configured to rotate, and wherein the corner brush comprises a spiral of bristles.

Clause 10. The surface cleaning device of any preceding clause, wherein the brushes are coupled to the sweeper assembly about a perimeter of the housing; and wherein the sweeper assembly defines a gap between the bristles and the brush chambers.

Clause 11. The surface cleaning device of any preceding clause, further comprising:

a handle assembly having a tubular shape and extending between a first end and a second end, wherein the cleaning head is configured to couple to the second end of the handle assembly;

a battery assembly coupled to the handle assembly; and a switch coupled to the handle assembly proximal to the first end and in communication with the battery assembly.

Clause 12. The surface cleaning device of any preceding clause, further comprising:

a first magnet coupled to the handle assembly; and a second magnet coupled to the cleaning head, wherein the cleaning head is configured to rotate toward the handle assembly until the second magnet engages with the first magnet.

Clause 13. The surface cleaning device of any preceding clause, further comprising:

a motor coupled to the cleaning head and configured to rotate the brushes, wherein the brushes moves debris into a debris container;

a motor switch coupled to the motor, wherein the motor switch is configured to control a speed of the motor, wherein the speed includes at least one of a first speed and a second speed; and a joint configured to couple the second end of the handle assembly to the cleaning head, wherein wiring is disposed within the handle assembly and the joint to couple the battery assembly to the motor and the motor switch.

Clause 14. A surface cleaning device, comprising:

a cleaning head comprising a housing, wherein the housing defines an inlet and comprises brush chambers adjacent to a perimeter of the housing;

at least one vent coupled to a top portion of the cleaning head; and a sweeper assembly coupled to the housing and comprising brushes having bristles, wherein the sweeper assembly defines a gap between the bristles and the brush chambers; and wherein the cleaning head is configured create a suction with a surface by directing air flow into the housing through the inlet and out of the housing through the at least one vent.

Clause 15. The surface cleaning device of any preceding clause, wherein each of the brushes further comprise a roller;

wherein the bristles further comprise one or more sets of soft and hard bristles coupled to the roller; and wherein the one or more sets of soft and hard bristles extend radially outwardly from the roller.

Clause 16. The surface cleaning device of any preceding clause, wherein at least one of the one or more sets of soft bristles is adjacent to at least one of the one or more sets of hard bristles; and wherein at least one of the one or more sets of hard bristles is adjacent to at least one of the one or more sets of soft bristles.

Clause 17. The surface cleaning device of any preceding clause, wherein the sweeper assembly further comprises:

corner brushes coupled to corners of the sweeper assembly, wherein each of the corner brushes comprise a spiral of hard bristles.

Clause 18. A surface cleaning device, comprising:

a handle assembly having a tubular shape and extending between a first end and an opposing second end;

a cleaning head coupled to the second end of the handle assembly and comprising a housing, wherein the housing defines an inlet and comprises brush chambers;

a sweeper assembly coupled to the housing, wherein the sweeper assembly comprises brushes having soft and hard bristles;

at least one vent coupled to a top portion of the housing, wherein the cleaning head is configured create a suction with a surface by directing air flow into the housing through the inlet and out of the housing through the at least one vent;

a rim coupled to a bottom edge of the housing, wherein the rim is configured to reduce an amount of tangle debris contacting the brushes and break the tangle debris in contact with the soft and hard bristles; and a debris container coupled to the housing, the debris container comprising an angled flap configured to move at least one of debris and the tangle debris into the debris container.

Clause 19. The surface cleaning device of any preceding clause, further comprising:

a first magnet coupled to the handle assembly; and a second magnet coupled to the cleaning head;

wherein the cleaning head rotates toward the handle assembly until the second magnet engages with the first magnet.

Clause 20. The surface cleaning device of any preceding clause, further comprising:

a battery assembly coupled to the handle assembly; and a switch coupled to the handle assembly proximal to the first end and in communication with the battery assembly.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A surface cleaning device, comprising:

a cleaning head comprising a housing, wherein the housing defines an inlet and comprises brush chambers;

at least one vent coupled to a top portion of the housing; and a sweeper assembly coupled to the housing and comprising brushes having bristles, wherein the cleaning head is configured create a suction with a surface by directing air flow into the housing through the inlet and out of the housing through the at least one vent.

2. The surface cleaning device of claim 1, further comprising:

at least two tabs coupled to a bottom portion of the cleaning head and configured for sliding across the surface.

3. The surface cleaning device of claim 1, wherein the at least one vent further comprises:

a first vent coupled to a first portion of the cleaning head; and a second vent coupled to a second portion of the cleaning head, wherein the suction is created by air flowing into the housing through the inlet and out of the housing through the first vent and the second vent.

4. The surface cleaning device of claim 1, further comprising:

a vent cover removably coupled to one of the at least one vent; and a vent tab coupled to the vent cover, wherein the vent tab is configured to lock and unlock the vent cover from the at least one vent.

5. The surface cleaning device of claim 1, further comprising:

a debris container disposed within the housing, the debris container defining a debris inlet configured to store debris; and a debris release trigger disposed on the top portion of the cleaning head, wherein the debris release trigger is configured to release a lid pivotably coupled to the debris container to open the debris container for removal of the debris from the debris container.

6. The surface cleaning device of claim 1, further comprising:

a rim coupled to a bottom edge of the housing, wherein the rim is configured to at least one of preventing tangle debris from contacting the brushes and breaking the tangle debris in contact with the brushes.

7. The surface cleaning device of claim 6, wherein the rim comprises teeth.

8. The surface cleaning device of claim 1, wherein each of the brushes further comprise a roller;

wherein the bristles further comprise one or more sets of soft and hard bristles coupled to the roller; and wherein each of the one or more sets of soft and hard bristles alternate in position along the roller.

9. The surface cleaning device of claim 1, further comprising:

a corner brush coupled to a corner of the sweeper assembly, wherein the corner brush is configured to rotate, and wherein the corner brush comprises a spiral of bristles.

10. The surface cleaning device of claim 1, wherein the brushes are coupled to the sweeper assembly about a perimeter of the housing; and wherein the sweeper assembly defines a gap between the bristles and the brush chambers.

11. The surface cleaning device of claim 1, further comprising:

a handle assembly having a tubular shape and extending between a first end and a second end, wherein the cleaning head is configured to couple to the second end of the handle assembly;

a battery assembly coupled to the handle assembly; and a switch coupled to the handle assembly proximal to the first end and in communication with the battery assembly.

12. The surface cleaning device of claim 11, further comprising:

a first magnet coupled to the handle assembly; and a second magnet coupled to the cleaning head, wherein the cleaning head is configured to rotate toward the handle assembly until the second magnet engages with the first magnet.

13. The surface cleaning device of claim 11, further comprising:

a motor coupled to the cleaning head and configured to rotate the brushes, wherein the brushes moves debris into a debris container;

a motor switch coupled to the motor, wherein the motor switch is configured to control a speed of the motor, wherein the speed includes at least one of a first speed and a second speed; and a joint configured to couple the second end of the handle assembly to the cleaning head, wherein wiring is disposed within the handle assembly and the joint to couple the battery assembly to the motor and the motor switch.

14. A surface cleaning device, comprising:

a cleaning head comprising a housing, wherein the housing defines an inlet and comprises brush chambers adjacent to a perimeter of the housing;

at least one vent coupled to a top portion of the cleaning head; and a sweeper assembly coupled to the housing and comprising brushes having bristles, wherein the sweeper assembly defines a gap between the bristles and the brush chambers; and wherein the cleaning head is configured create a suction with a surface by directing air flow into the housing through the inlet and out of the housing through the at least one vent.

15. The surface cleaning device of claim 14, wherein each of the brushes further comprise a roller;

wherein the bristles further comprise one or more sets of soft and hard bristles coupled to the roller; and wherein the one or more sets of soft and hard bristles extend radially outwardly from the roller.

16. The surface cleaning device of claim 15, wherein at least one of the one or more sets of soft bristles is adjacent to at least one of the one or more sets of hard bristles; and wherein at least one of the one or more sets of hard bristles is adjacent to at least one of the one or more sets of soft bristles.

17. The surface cleaning device of claim 14, wherein the sweeper assembly further comprises:

corner brushes coupled to corners of the sweeper assembly, wherein each of the corner brushes comprise a spiral of hard bristles.

18. A surface cleaning device, comprising:

a handle assembly having a tubular shape and extending between a first end and an opposing second end;

a cleaning head coupled to the second end of the handle assembly and comprising a housing, wherein the housing defines an inlet and comprises brush chambers;

a sweeper assembly coupled to the housing, wherein the sweeper assembly comprises brushes having soft and hard bristles;

at least one vent coupled to a top portion of the housing, wherein the cleaning head is configured create a suction with a surface by directing air flow into the housing through the inlet and out of the housing through the at least one vent;

a rim coupled to a bottom edge of the housing, wherein the rim is configured to reduce an amount of tangle debris contacting the brushes and break the tangle debris in contact with the soft and hard bristles; and a debris container coupled to the housing, the debris container comprising an angled flap configured to move at least one of debris and the tangle debris into the debris container.

19. The surface cleaning device of claim 18, further comprising:

a first magnet coupled to the handle assembly; and a second magnet coupled to the cleaning head;

wherein the cleaning head rotates toward the handle assembly until the second magnet engages with the first magnet.

20. The surface cleaning device of claim 18, further comprising:

a battery assembly coupled to the handle assembly; and a switch coupled to the handle assembly proximal to the first end and in communication with the battery assembly.

* * * * *